United States Patent [19]

Watanabe et al.

[11] 4,127,334

[45] Nov. 28, 1978

[54] DOT PRINTER

[75] Inventors: Akinori Watanabe; Masao Sasaki, both of Tokyo, Japan

[73] Assignee: Oki Electric Industry Co., Ltd., Tokyo, Japan

[21] Appl. No.: 732,998

[22] Filed: Oct. 18, 1976

[51] Int. Cl.[2] ..... B41J 3/12

[52] U.S. Cl. ..... 400/124; 400/320

[58] Field of Search ..... 197/1 R; 101/93.04, 101/93.05

[56] References Cited

U.S. PATENT DOCUMENTS

| | | | |
|---|---|---|---|
| 3,357,533 | 12/1967 | Artzt | 197/1 R |
| 3,802,544 | 4/1974 | Howard et al. | 197/1 R |
| 3,941,051 | 3/1976 | Barrus et al. | 101/93.04 |
| 3,967,714 | 7/1976 | Potma et al. | 197/1 R |
| 3,999,644 | 12/1976 | Pape et al. | 197/1 R |
| 4,010,835 | 3/1977 | Martin et al. | 197/1 R |

*Primary Examiner*—Paul T. Sewell

*Attorney, Agent, or Firm*—Peter L. Berger

[57] ABSTRACT

A new and novel dot printer for printing characters of dot matrix or the like by sliding a slide member in the direction of a row, said slide member being provided with a plurality of dot printing elements which are arranged in line thereon at a predetermined distance, wherein plate springs are provided on both ends of the slide member as a guide, support and return mechanism so that guide, support as well as return power are assured for said slide member.

7 Claims, 9 Drawing Figures

DOT PRINTER

BACKGROUND OF THE INVENTION

As processing speeds in central processing units of electronic computors has been increased, high speed printers of the terminal units must be operated at higher speeds.

As well known, a variety of types of high speed printers are available. Among them the present invention is concerned with a dot printer for printing dot matrix characters, numerals, symbols or the like simultaneously, each of which is arranged in a row, while a plurality of dot printing elements are reciprocally displaced in the direction of the row, said dot printing elements being arranged in line in said direction at predetermined distances.

This type of printer for expressing characters or the like, such as the dot matrix, wire dot printer, thermal printer and others are widely known. For instance, a wire dot printer is provided with a plurality of printing solenoids on a slide member, each of which is disposed opposite to a platen and a printing paper. The slide member is adapted to be moved in a reciprocal manner in parallel with the printing paper. With such arrangement for the wire dot printer, printing is performed by displacement of the slide member as a primary scan operation and the feeding movement of the printing paper as a secondary scan operation, so as to print simultaneously a plurality of dot matrix characters which are located in a row.

Further to the above arrangement of the dot printer, there is provided a wire which is connected to said printing solenoid extending toward an ink ribbon. When the solenoid is excited, the wire is displaced to depress the ink ribbon against the printing paper so that a dot is printed thereon.

Usually the slide member is reciprocally moved with the aid of a motor as a power source for driving, wherein rotary motion is converted into linear motion by way of a suitable transmission mechanism.

SUMMARY OF THE INVENTION

The present invention provides a dot printer on which comb-like plate springs having three tongue pieces are mounted on both ends of a slide member in order to assure guide, support and return force for the slide member, two pieces of said tongue at the end portions of the plate spring being secured to a frame, while the other piece situated therebetween is secured to said end of the slide member.

OBJECT OF THE INVENTION

The first object of the invention is to provide a dot printer which is constructed such that a slide member can be moved back with the aid of spring force from a plate spring which is mounted on the frame, said slide member being provided with a plurality of dot solenoids arranged in line thereon.

The second object of the invention is to provide a dot printer which is adapted to guide and support the slide member, which is mounted on the frame by way of the plate spring at both ends thereof.

The third object of the invention is to provide a dot printer which is constructed such that possible vibration on the frame is prevented with the aid of weight which is secured to the frame by way of plate springs located therebetween.

DETAILED DESCRIPTION OF THE INVENTION

Figure 1:
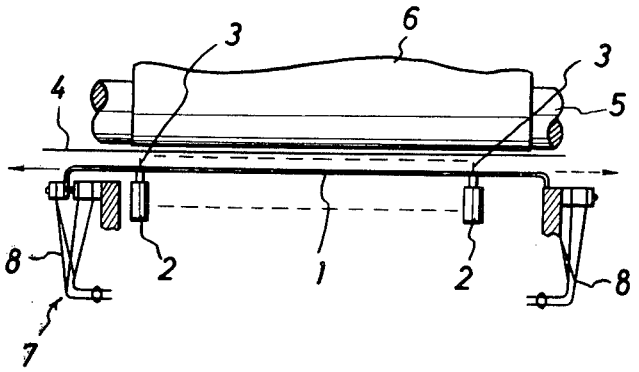
FIG. 1 is a schematic plan view of a dot printer according to the present invention.
Figure 2:
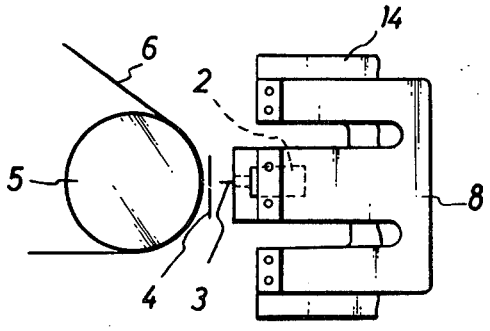
FIG. 2 is a side view of the dot printer in FIG. 1 shown in an enlarged scale.

FIG. 1 is a schematical plan view illustrating an embodiment of the dot printer according to the present invention, while FIG. 2 is a side view of the same.

On slide plate 1 which is reciprocally movable in the horizontal direction, there is provided a plurality of printing solenoids 2. Wire 3 which is connected to a moving part of said printing solenoid 2 extends toward ink ribbon 4. As the printing solenoid 2 is excited, said wire 3 is displaced to depress said ink ribbon 4 against printing paper 6 on platen 5 so that a dot printing is established thereon.

Figure 3:
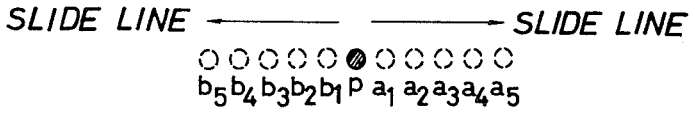
FIG. 3 is an illustration of printing operation of the dot printer in FIG. 1.

FIG. 3 illustrates positions of dots to be printed. The wire 3 is initially situated at the dot position P as hatched in FIG. 3. In case that the slide plate 1 slides to the right, the wire 3 prints a dot at the position *a*1 – *a*5, while in case said slide plate 1 does to the left, the wire 3 does so at the position *b*1 – *b*5. FIG. 3 shows, for instance, a case where a dot matrix character of 5 × 7 is printed on the printing paper 6 on the left and right sides, respectively. It will be obvious that many more characters may be printed thereon. It is to be noted that a plurality of dot matrix characters are simultaneously printed in a row on the printing paper 6 by means of the reciprocal movement of said wire 3 and the sliding activity of said slide plate 1 as primary scan operation and the feeding movement of said printing paper 6 as secondary scan operation.

Figure 4:
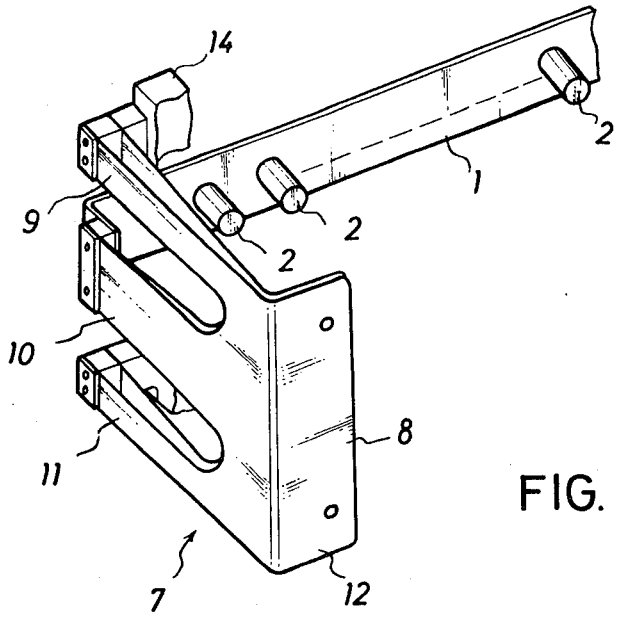
FIG. 4 is a perspective view of a comb-like plate spring for the dot printer in FIG. 1.

As shown in more detail in FIG. 4, the numeral 7 is a guide, support and return mechanism, which comprises a guide and support function for guiding and supporting the sliding activity of the slide plate 1 and a function for providing said slide plate 1 with return force. To effect said functions, two comb-like plate springs 8 are provided. The numeral 13 is another guide, support and return mechanism and is constructed in the same manner as said mechanism 7. This comb-like plate spring 8 may comprise a single plate, but it is conveniently constructed by two plates as illustrated in FIG. 4 so as to improve its rigidity in the direction toward the platen.

Figure 5:
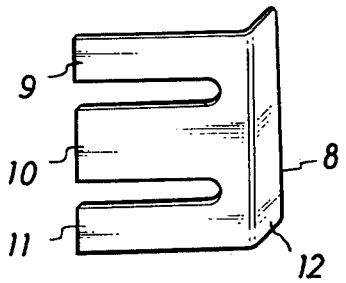
FIG. 5 is another perspective view of the comb-like plate spring in FIG. 4.

The comb-like plate spring 8 comprises first tongue 9, second tongue 10 and third tongue 11 as shown in FIG. 5, each of which has the same length. The comb-like plate springs 8 are bent at a substantially right angle in position adjacent to the lower portion of said tongues to form the base 12. The first tongue 9 and the third tongue 11 of said two comb-like plate spring 8 are secured to the frames 14 and 15 of the unit at their free ends in such a manner that clearance therebetween at the free end is wider than that at the bottom portion thereof, while the second tongue 10 is secured to the slide plate 1 also at the free end in such a manner that the free extreme ends thereof are closely united. On the other hand the bent portions of said two comb-like plate springs 8 are tightly connected together around at end portion of the base 12 with the aid of rivet or the like.

Figure 6:
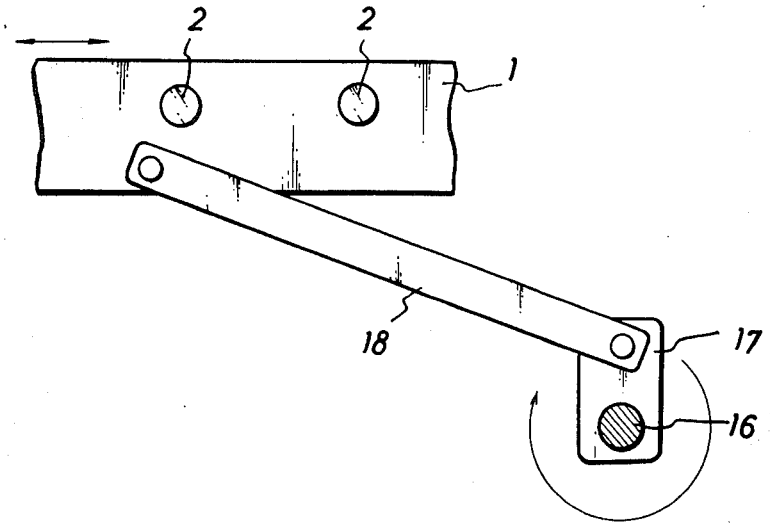
FIG. 6 is an enlarged side view of the driving mechanism as shown in FIG. 1.

FIG. 6 shows a driving mechanism for displacing reciprocally the slide plate 1. The numeral 16 is a driving shaft which is coupled to a power source for driving (not shown here), the numeral 17 is a crank which is rotated together with said driving shaft 16, and the numeral 18 is a link, one end of which is jointed rotatably onto said crank 17 and the other end thereof is onto the slide plate 1. Thus as the driving shaft 16 is rotated, the crank 17 is also rotated together therewith, causing the slide plate 1 to be reciprocally moved by way of said link 18. Hence the slide plate 1 is movable horizontally in the right or left directions at a constant distance from the platen 5 and the printing paper 6 with the aid of said guide support and return mechanism 7 and 13.

Figure 7:
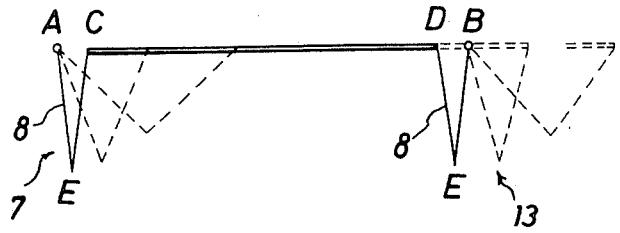
FIG. 7 is a schematic illustration of the operation of the sliding plate.

FIG. 7 is a simplified schematical illustration of movement of the guide and support mechanism 7 and 13 as well as the slide plate 1. The letters A and B are fixed points for the tongue 9 and 11 of the comb-like plate spring, the letters C and D are other fixed points onto which the tongue 10 of said comb-like plate spring 8 is secured at both ends of the slide plate, and the letter E is a base, as refered to as base 12 common to said tongue 9, 10 and 11. As the slide plate 1 is displaced to the right, as shown in FIG. 7, two triangles are produced by making line connections among a group of fixed points A, E and C as well as another group of fixed points B, E and D on the first and third tongue 9 and 11 and the second tongue 10, all of which has the same length, wherein the comb-like plate spring 8 is deformed at any time such that the resultant triangle is an equilateral triangle. The distance between the platen 5 an the base E fluctuates slightly, but as the fixed point C and D at both ends of the slide plate 1 are displaced without making any change of the distance between the slide plate 1 and the platen 5, the slide plate 1 is displaced in parallel to the platen 5. After the slide plate 1 completes the above described parallel movement to the right, dot printing is conducted in the position *a*1 to *a*5 as shown in FIG. 3. When the slide plate is required to turn back to the initial position P, the deformed comb-like plate spring 8 serves to exert return force on the slide plate 1. It will be obvious that returning back is effected under influence of the deformed comb-like plate spring 8 in the entirely same manner as above, when another dot printing is performed in the position *b*1 to *b*5 in FIG. 3 during movement of the slide plate 1 to the left.

Figure 8:
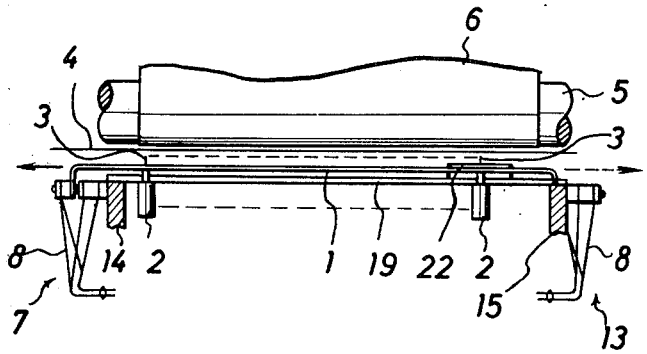
FIG. 8 is another schematic plan view of the dot printer according to the present invention.
Figure 9:
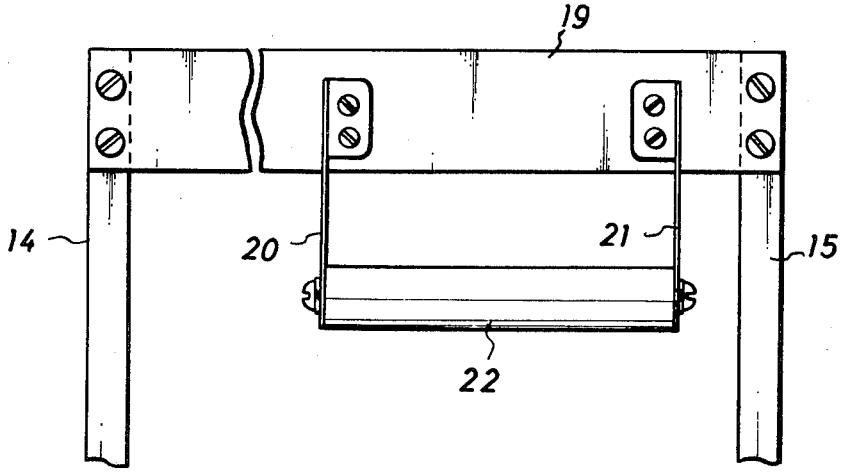
FIG. 9 is an enlarged side view of the arrangement of the weight for the frame in FIG. 8.

FIG. 8 illustrates another embodiment of the dot printer according to the present invention, of which detailed arrangement is shown in FIG. 9.

As described above, during the reciprocally movement of the slide plate 1 with the aid of the driving mechanism shown in FIG. 6, return force due to deformation of the comb-like plate spring 8 in the guide, support and return mechanism 7 and 13 is exerted on the slide plate 1. At the same time the return force is transmitted to the frame 14 and 15 via the slide plate 1 — th link 18 — the crank 17 — the driving shaft 16, the fram vibrates. FIG. 9 shows an arrangement to eliminate th undesirable vibration. As illustrated therein, a combina tion of plate spring 20 and 21 and weight 22 is provide on beam 19 by which the frame 14 and 15 are joined said weight 22 being bridged between said plate spring 20 and 21 in parallel to the beam 19. Thus possible vibra tion is effectively prevented.

As mentioned above, in accordance with the presen invention a comb-like plate spring is proposed as a sup port member, guide member plus return member for th slide plate which is provided with a plurality of do printing elements, each of which is arranged in lin thereon at a predetermined distance. This enables th dot printer to be simplified in its structure and be manufactured at lower cost.

As an additional advantage of the dot printer of th present invention vibration of the frame can be prevented.

What is claimed is:

1. A dot printer for printing characters using a slid member slideable along the direction of the row being printed, said slide member being provided with a plurality of dot printing elements each of which is located a a predetermined distance from an adjacent element, a pair of connecting members located at opposite ends o said slide member connecting said slide member to the frame of said dot printer, said pair of connecting members operating to guide and support said slide member and return said slide member after each printing operation, said connecting members connecting said slide member to said frame in one direction and comprising leaf spring means to displace said slide member in a direction orthogonal to said one direction, said orthogonal direction being parallel to the direction of movement of the printing elements when printing, such that said slide member moves in the direction of movement of the printing elements as said slide member moves along the direction of the row being printed.

2. A dot printer as set forth in claim 1, wherein each of said connecting members comprises an integral member being connected between said frame and slide member, said integral member being flexible to form said leaf spring means for effecting said guide, support and return actions.

3. A dot printer as set forth in claim 2, wherein each of said connecting members comprises a comb-like plate spring comprising first, second, and third teeth, each having free ends, said first and third teeth being connected at their free ends to said frame, each of said second teeth being connected at their free ends to opposite ends of said slide member.

4. A dot printer as set forth in claim 3, wherein each of said teeth is formed of a pair of spring plate members.

5. A dot printer as set forth in claim 1, comprising damping means connected to said slide member to damp the return movement of said slide member.

6. A dot printer as set forth in claim 5, wherein said damping means comprises a weight secured to said frame.

7. A dot printer as set forth in claim 6, comprising a plate spring member connecting said weight to said frame.

* * * * *

UNITED STATES PATENT AND TRADEMARK OFFICE

CERTIFICATE OF CORRECTION

PATENT NO. : 4,127,334

DATED : November 28, 1978

INVENTOR(S) : Akinori Watanabe et al.

It is certified that error appears in the above-identified patent and that said Letters Patent are hereby corrected as shown below:

Column 2, line 7, after "of" (first occurrence) insert --the--.

Column 2, line 24, delete "schematical" and insert --schematic--.

Column 3, line 16, delete "jointed" and insert --joined--.

Column 3, line 41, delete "an" and insert --and--.

Column 4, line 1, delete "th" and insert --the--.

Column 4, line 2, delete "fram" and insert --frame--.

Column 4, line 3, delete "th" and insert --the--.

Column 4, line 4, delete "combina" and insert --combina- --.

Column 4, line 5, delete "provide" and insert --provided--.

Column 4, line 6, after "joined", insert --,--.

Column 4, line 7, delete "spring" and insert --springs--.

Column 4, line 8, delete "vibra" and insert --vibra- --.

UNITED STATES PATENT AND TRADEMARK OFFICE

CERTIFICATE OF CORRECTION

PATENT NO. : 4,127,334

DATED : November 28, 1978

INVENTOR(S) : Akinori Watanabe et al.

It is certified that error appears in the above-identified patent and that said Letters Patent are hereby corrected as shown below:

Column 4, line 10, delete "presen" and insert --present--.

Column 4, line 11, delete "sup" and insert --sup- --.

Column 4, line 13, delete "do" and insert --dot--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*